US009201366B2

(12) United States Patent
Creteau et al.

(10) Patent No.: US 9,201,366 B2
(45) Date of Patent: Dec. 1, 2015

(54) FLAT HEATER FOR ELECTROPHOTOGRAPHIC BELT FUSING SYSTEMS, AND METHODS OF MAKING SAME

(75) Inventors: Gregory Daniel Creteau, Winchester, KY (US); James Douglas Gilmore, Georgetown, KY (US); Michael David Maul, Lexington, KY (US); Miranda Elizabeth Oaks, Lexington, KY (US); Katherine Mary Mulloy, Lexington, KY (US); Niko Jay Murrell, Lexington, KY (US); Jerry Wayne Smith, Irvine, KY (US); Scott Shiaoshin Wu, Lexington, KY (US)

(73) Assignee: Lexmark International, Inc.KY (US)

( * ) Notice: Subject to any disclaimer, the term of this patent is extended or adjusted under 35 U.S.C. 154(b) by 422 days.

(21) Appl. No.: 12/610,748

(22) Filed: Nov. 2, 2009

(65) Prior Publication Data

US 2011/0103853 A1 May 5, 2011

(51) Int. Cl.
*G03G 15/20* (2006.01)

(52) U.S. Cl.
CPC .... *G03G 15/2064* (2013.01); *G03G 2215/2035* (2013.01)

(58) Field of Classification Search
CPC ..... G03G 15/2064; H05B 3/28; H05B 3/265
USPC ..... 399/329
See application file for complete search history.

(56) References Cited

U.S. PATENT DOCUMENTS

| | | | | |
|---|---|---|---|---|
| 5,376,773 | A * | 12/1994 | Masuda et al. | 219/543 |
| 5,499,087 | A * | 3/1996 | Hiraoka et al. | 399/329 |
| 5,819,149 | A * | 10/1998 | Watanabe et al. | 399/330 |
| 6,787,737 | B2 | 9/2004 | Uekawa et al. | |
| 6,791,069 | B2 * | 9/2004 | Sako et al. | 219/543 |
| 2003/0077092 | A1 * | 4/2003 | Ogawa et al. | 399/328 |
| 2006/0056891 | A1 * | 3/2006 | Hashiguchi et al. | 399/329 |
| 2007/0193998 | A1 * | 8/2007 | Ichino | 219/216 |
| 2007/0258742 | A1 * | 11/2007 | Narahara et al. | 399/329 |

* cited by examiner

*Primary Examiner* — David Gray
*Assistant Examiner* — Andrew Do

(57) ABSTRACT

An image-forming device includes a belt based fuser for fixing an image to a media substrate. The fuser includes a heater having a base component with at least one heating element disposed thereon. The heater further includes a covering layer covering the at least one heating element providing a substantially even surface to abut a belt. Unevenness, which may be present on the substantially even surface, has a height, defined by a base and a peak, of less than about 10 μm. A process for producing the heater is also disclosed. The process includes disposing one or more heating elements on a base component of the heater, covering the heating elements of the fuser heater with a covering layer and providing a substantially even outer surface to abut a fuser belt.

15 Claims, 4 Drawing Sheets

FLAT HEATER FOR ELECTROPHOTOGRAPHIC BELT FUSING SYSTEMS, AND METHODS OF MAKING SAME

BACKGROUND

During operation of an image-forming device such as a laser printer or copier, a fuser permanently affixes toner particles to a media sheet in the final stage of a non-impact image-forming process. When fusing toner onto a substrate, the toner is heated to a point where the toner coalesces and appears tacky. The heat allows the toner to flow, thereby enabling it to coat the fibers or pores of the substrate. With the addition of pressure, an improved contact between the substrate and toner can be obtained. The heat and pressure required for fusing are achieved by a heated member and a pressure roller that under an applied force form a nip. Heat from the fuser melts the toner particles, while the applied pressure allows for absorption thereof into the media. Subsequent cooling of the toner, while it is in intimate contact with the substrate, allows it to adhere to the sheet.

The heater of the fuser may be mounted within a movable belt. During operation, stick-slip friction between the heating element and the belt introduces vibration and noise that prematurely wear the components and can affect image quality. While lubrication between the heater and belt can reduce the vibration and noise, it may be difficult to retain such lubrication in the desired location over time, under the heat and pressure of the components during ongoing operation of the device.

This problem is exacerbated over the life of the printer, as over time, the fuser lubricant migrates away from any high-pressure areas present on the heater glass.

One factor that has a significant effect on belt vibration noise is any uneven areas of the heater external surface which is in contact with the belt. Uneven areas of the heater can scrape the grease off the inside of the fuser belt and reduce the film thickness in the areas with high pressure contact. In addition, if the amount of waviness and/or unevenness in the outer surface of the heater is greater than the grease thickness, areas of contact between the outer heater surface and the fuser belt may undesirably operate with boundary layer lubrication and stick-slip may occur, thereby causing vibration and noise.

The conventional screening method used to make ceramic heaters leaves raised portions on the surface in the areas of the resistive traces.

Referring now to FIGS. 3A-3B, there is shown an enlarged, partial, cross-sectional view of a known fuser heater 40. Heating elements 56 are disposed on a base 54 and a protective, covering layer 62 is disposed over heating elements 56 and the corresponding surface of base 54. As can be seen in FIGS. 3A and 3B, the outer surface of covering layer 62 does not provide a substantially even surface due to protruding nature of the heating elements 56 relative to the surface of base 54 as well as to unevenness in the heating elements 56 themselves.

FIG. 3B shows the general shape of the heating elements 56 in the known fuser heater 51 taken at a greater magnification than FIG. 3A. As shown in FIG. 3B, the actual edges of heating elements 56 are slightly raised, creating areas of high contact pressure in covering layer 62, thereby contributing to the unevenness in the outer surface thereof. The outer surface of heating elements 56 have been seen to be substantially meniscus shaped. The amount of unevenness in the outer surface of known heater 51, which can be seen as dimension H in FIG. 3B, has been seen to be greater than 12 μm.

Published references pertaining to fusers, ceramic heaters and related technology include U.S. Pat. Nos. 6,157,806, 6,818,290, 6,865,351, 6,870,140, 6,879,803, and 7,193,180, which are assigned to the assignee of the present application and hereby incorporated by reference into the application in their entirety.

Although the known fuser assemblies have some utility for their intended purposes, a need still exists in the art for an improved heater for a fuser assembly usable in electrophotography, as well as to methods of making such an improved heater.

SUMMARY

Exemplary embodiments of the present invention provide an improved heater for a fuser assembly usable in electrophotography, as well as methods of making such an improved heater. An improved heater according to the exemplary embodiments exhibit improved flatness of an exterior surface thereof which comes into contact with a belt of the fuser.

The fuser includes a heater having a base component with at least one heating element disposed thereon. The heater further includes a covering layer covering the at least one heating element providing an outer surface to abut a belt. In addition, any unevenness on the outer surface is reduced by providing a filler material in low portions of the covering layer. The unevenness remaining in the outer surface of the heater is less than about 10 μm.

BRIEF DESCRIPTION OF THE DRAWINGS

The features and advantages of the various exemplary approaches of this disclosure, and the manner of attaining them, will become more apparent and better understood by reference to the accompanying drawings, wherein.

DETAILED DESCRIPTION

Figure 1:
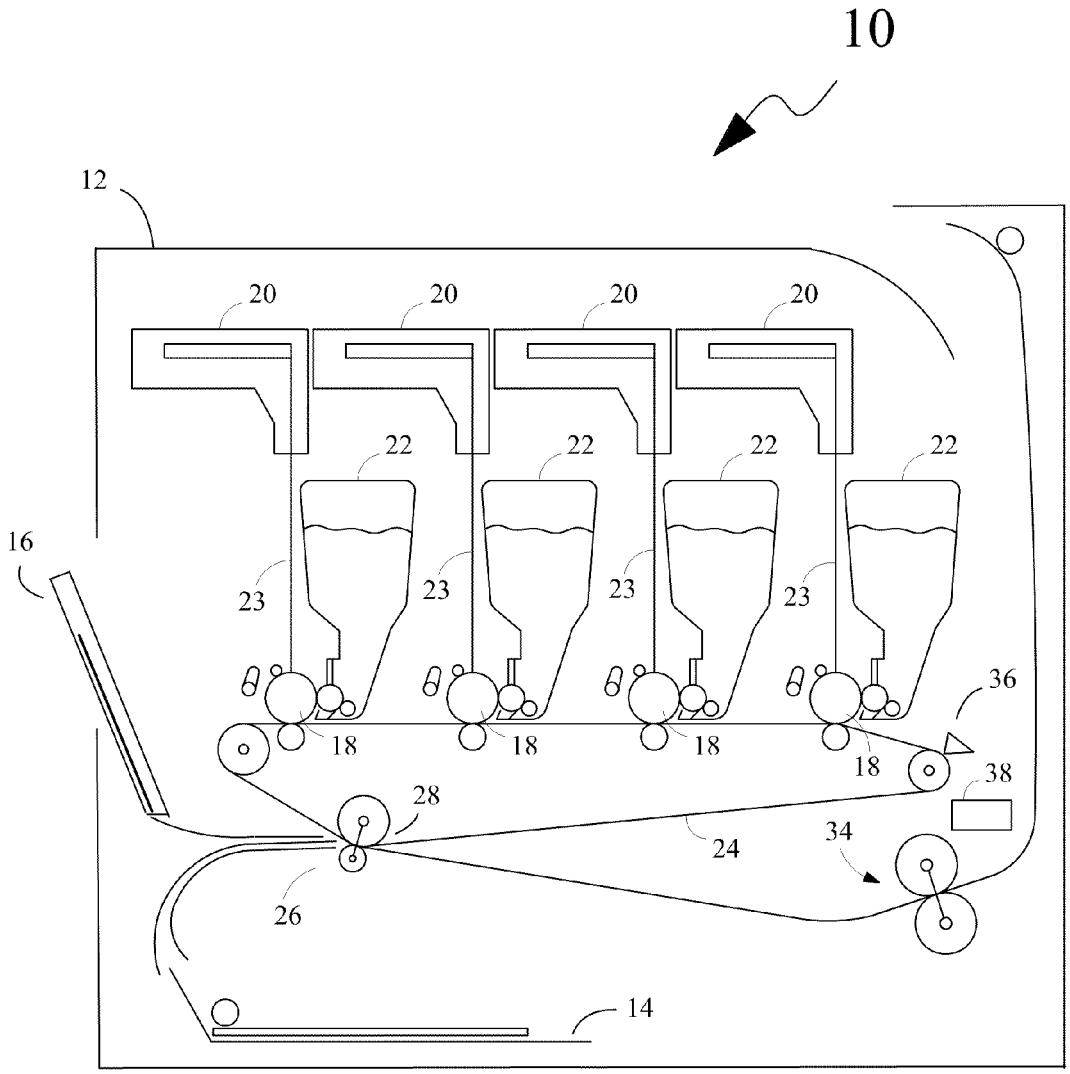
FIG. 1 is an overall system view of an exemplary image-forming device.

It is to be understood that the following disclosure and claims are not limited in application to the details of construction and the arrangement of components set forth in the following description or illustrations. The disclosure is capable of other exemplary approaches and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that exemplary approaches described herein include both hardware and electronic components or modules that, for purposes of discussion, may be illustrated and described as if the majority of the components were implemented solely in hardware. However, one would recognize that, in at least one exemplary approach, the electronic based aspects of the disclosure may be implemented in software. As such, it should be noted that a plurality of hardware and software-based devices, as well as a plurality of different structural components may be utilized to implement the exemplary approaches described herein. Furthermore, and as described in subsequent paragraphs, the specific mechanical configurations illustrated in the drawings merely provide exemplary approaches and that other alternative mechanical configurations are possible.

FIG. 1 depicts an exemplary image-forming device 10 that allows for an image to be formed on a media substrate by way of a multi-step image-forming process along a media path. A fuser 34, which fuses or fixes the image to the media in one of the final steps of the image-forming process, will be discussed, along with the lubricant thereof, in detail below with respect to FIG. 2. The term "image-forming device," and the like, is generally used herein as a device that produces images on printable media sheets. Examples include, but are not limited to, laser printers, LED printers, copy machines, etc. Commercially available examples of image-forming devices include Model Nos. C540, C750 and C752 of Lexmark International, Inc. of Lexington, Ky.

As shown in FIG. 1, the image-forming device 10 includes a main body 12 that houses media handling elements such as a media tray 14, a manual media sheet feeder 16, and various depicted belts and rollers. The main body 12 also houses imaging elements such as a plurality of photo-conductive drums 18, imaging devices 20, removable toner cartridges 22, an intermediate transfer belt 24, a secondary transfer point 26, a fuser 34, and a waste toner collector 36.

The cartridges 22 include the same sub-elements and are only distinguished by the color of the toner contained therein. As depicted, the image-forming device 10 includes four cartridges 22, with colors black (K), magenta (M), Cyan (C), and yellow (Y). Each cartridge forms an individual mono-color image that is combined in a layered manner with images from the other cartridges to create the final multi-colored image. Each cartridge 22, which may be individually removable, includes a reservoir holding a supply of toner and a developer roller for applying toner to the respective photo-conductive drum 18. The photo-conductive drum 18 may be an aluminum hollow-core drum coated with one or more layers of light-sensitive organic photo-conductive materials. The drum 18 may be charged over its entire surface allowing for the imaging device 20 to discharge a portion of the surface with a laser beam 23, or the like. The discharged portion of the drum 18 corresponds to the image layer that will be covered with toner from the respective cartridge 22.

Toner is drawn by electrostatic force from the developer roll of the cartridge 22 to the discharged area of the drum 18. The endless intermediate transfer belt 24 rotates continuously in cooperation with the drums 18. A potential difference between the belt 24 and the drums 18 forces the toner particles from each of the drums onto the belt 24. The belt 24 and drums 18 are synchronized so that the toner from each drum precisely aligns to form the layered multi-colored image.

Media may be drawn from either the manual feeder 16 or the media tray 14 and delivered along the media path to the secondary transfer point 26. The timing of the media arrival is synchronized with the portion of the belt 24 carrying the completed image in order to transfer the toner from the belt to the media. At the secondary transfer point 26, the toner and the media move through an electric field at the exact point of transfer, or transfer nip 28, created between a positively-biased second transfer roller and a grounded backup roller. At the transfer nip 28, the negatively charged toner particles become sandwiched between the belt 24 and the media. The electric field between the second transfer roller and the backup roller, which form secondary transfer point 26, forces the toner to be released from the belt 24 and transferred onto the media. Subsequent to the toner transfer, the media passes through the fuser 34, which applies heat and pressure to permanently affix the toner to the media. A waste toner cleaner 36 removes any residual toner particles from the belt 24.

The above-described printing process may be controlled by a controller such as an electronic processor 38. While not depicted in detail, the processor 38 includes a processing unit and associated memory, and may be formed as one or more Application Specific Integrated Circuits (ASIC). The memory may be, for example, random access memory (RAM), read only memory (ROM), and/or non-volatile RAM (NVRAM). Alternatively, the memory may be in the form of a separate electronic memory (e.g., RAM, ROM, and/or NVRAM), a hard drive, a CD or DVD drive, or any memory device convenient for use with the processor 38. Regardless of the particular implementation, the memory provides a computer readable medium that may be encoded with computer instructions for controlling the processor 38 to carryout the printing process as well as the methods described below. The processor 38 may further include an I/O controller and I/O ports for communicating with an external computing or processing device. Moreover, computer instructions for implementing the image-forming process and the methods described herein may be provided to the device 10 via the I/O ports from a computer readable medium associated with the external processing device.

Figure 2:
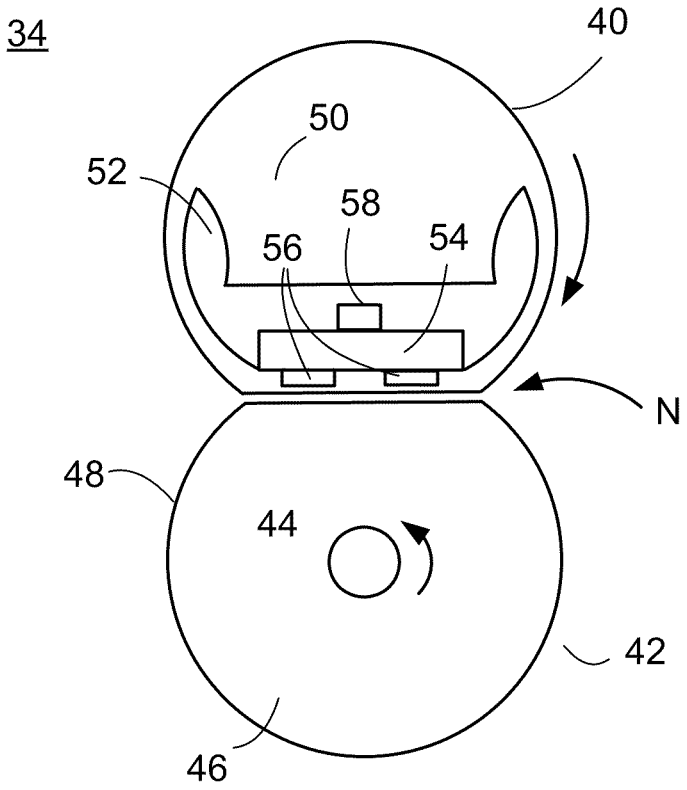
FIG. 2 is a side, cross-sectional view of an exemplary belt fuser assembly.
Figure 3A:
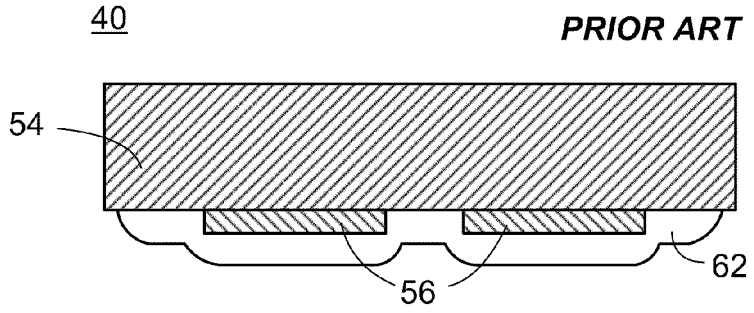
FIG. 3A is a partial, cross-sectional view of a prior art fuser heater which is a component of the belt fuser assembly of FIG. 2.
Figure 3B:
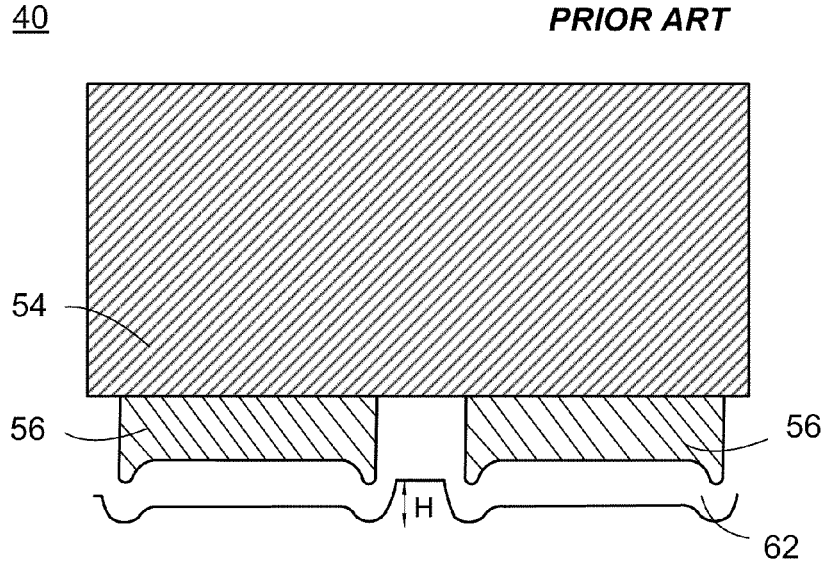
FIG. 3B is an enlarged detail view of a portion of the prior art fuser heater of FIG. 3A.

FIG. 2 depicts a cross-sectional, side view of an exemplary belt-based fuser 34. The fuser 34 includes an endless belt 40 that abuts a pressing roller 42 to form a fixing nip (N). The pressing roller 42 may include a central shaft 44, typically formed from steel, aluminum, or similar metal; a rubber elastic layer 46 made of silicone rubber; and an exterior parting layer 48, typically comprising a PFA sleeve. The pressing roller 42 urges the belt and any passing media against the bottom surface of a heater assembly 50 by way of a biasing member or the like (not shown). The pressing roller 42 is driven by an attached gear (not shown) through connection with a gear series to the printer mechanism gear train. The rotation of the pressing roller 42 drives the belt 40, thereby moving media through the fixing nip N.

The belt 40 is an endless tube, which is continuously rotated by contact with the pressing roller 42 for fixing a toner image to a media substrate. The belt 40 is typically made of a highly heat resistive and durable material having good parting properties. The belt 40 typically has total thickness of not more than about 100 microns, and may be less than about 55 microns. The belt 40 is usually electrically conductive. It is understood that belt 40 may have any of a number of different layers and compositions, the details of which will not be further described herein for reasons of simplicity.

As shown in FIG. 2, the heater assembly 50 may include a holder 52 that supports the belt. The heater assembly 50 may include a ceramic substrate or base member 54 that extends in a direction substantially perpendicular to the direction of movement of belt 40 along the fixing nip N. The base member 54, which is electrically insulating, has a high heat resistance. One or more heating elements 56, typically electrically resistive traces, are disposed in a line or strip extending along the length of base member 54 on the surface thereof that is adjacent to or otherwise faces endless belt 40 and pressing roller 42. Passing an electrical current through heating elements 56 via electrical conductors (not shown) generates heat which is used to fuse toner to the media sheet as it passes through fixing nip N. A temperature detecting element 58, for example, a thermistor or thermocouple, is mounted in contact with the surface of base member 54 opposite the surface having heating elements 56. Temperature detecting element 58 may be used to control the operation of heater assembly 50 in order to achieve the appropriate temperature for fusing.

A thin covering layer 62 (shown in FIGS. 4-7) covers the heating elements 56 and provides a surface to abut the belt 40. The covering layer 62 may be a coating of glass placed over the heating elements 56 and the surface of base 54 adjacent belt 40 and provides electrical insulation and wear-resistance.

To facilitate the contact between the belt 40 and the surface of covering layer 62 of the heater assembly 50, a thin layer of grease (not shown) is disposed on the inner surface of the belt 40. The amount of grease is thin in relation to total thickness of belt 40, and is applied only in sufficient amounts within the fusing nip over the life of the fuser. In one exemplary approach, the full amount for that purpose may be applied during manufacture on the surface of covering layer 62.

Pressing roller 42 and heater assembly 50 of belt fuser 34 may be controlled by the processor 38. Heating assembly 50 may be operated at a temperature necessary to melt the toner in the fixing nip N, with the heat thereof transferring through the belt 40. The pressure from the pressure roller 42 causes the melted toner to substantially permanently adhere to the media sheet. As the media sheet exits the fixing nip N, the belt 40 peels away from the media, leaving the image deposited on the media, and the belt 40 then continues around the heater holder 52.

It is considered advantageous if the surface of heater assembly 50 that abuts belt 40 is substantially even in order to reduce stick-slip vibration noise. The substantially even surface should not have any areas of unevenness greater than about 10 μm valley-to-peak. In one exemplary embodiment hereof, the extent of unevenness present has a height in the range of about 0.1 μm to about 7 μm.

Figure 4A:
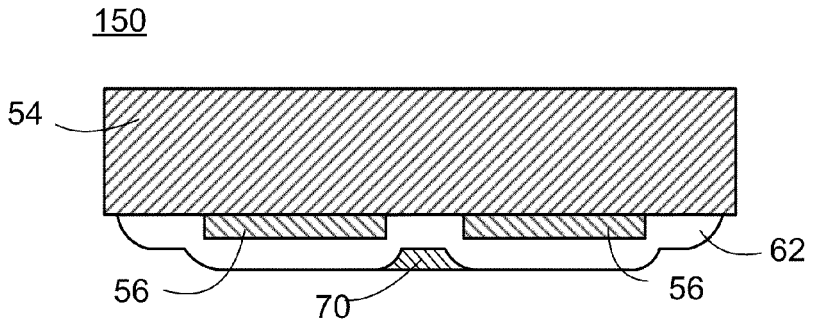
FIG. 4A is a partial, cross-sectional view of an improved fuser heater with added material thereon according to a first illustrative embodiment hereof.

As stated above with respect to prior heater assemblies, the surface of heater assemblies has a level of unevenness which may undesirably cause vibration and noise and adversely impact the lifetime of the fuser belt. Referring now to FIG. 4A through FIG. 7, a number of approaches for reducing the amount of unevenness are presented. In a first exemplary approach, as shown in FIG. 4A, the heater 150 is produced by disposing at least one heating element 56 on the base member 54. The base member 54 and heating element(s) 56 are then covered by a protective covering layer 62, such as glass.

To compensate for the inevitable unevenness produced in the covering layer 62 due to the presence of heating elements 56 on base member 54, an additional unevenness reduction step may be performed. In particular, a filler material 70 may be added to the outer external surface of the covering layer 62. The filler material 70 fills low points in the outer surface of heater 150 and thereby reduces the amount of surface unevenness. Use of filler material 70 has been seen to reduce the amount of surface unevenness to a range of about 0.1 μm to about 7 μm. In one exemplary approach, as shown in FIG. 4A, filler material 70 is only added to a single uneven surface region, such as the region located between the two heating elements 56. Testing has revealed that the region has a more significant role in causing stick-slip vibration noise.

The filler material 70 may have a number of different compositions. For example, filler material 70 may be glass, a high temperature polymeric material, e.g., polyimide, or other suitable high-strength, heat tolerant and heat conductive materials known in the art.

Figure 4B:
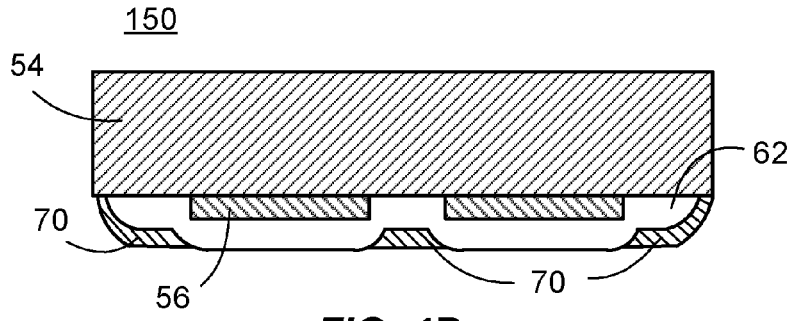
FIG. 4B is a partial, cross-sectional view of an improved fuser heater with added material thereon according to a second illustrative embodiment hereof.

In another exemplary approach, filler material 70 is added to all uneven surface regions along the surface of heater 150, as illustrated in FIG. 4B.

Figure 5:
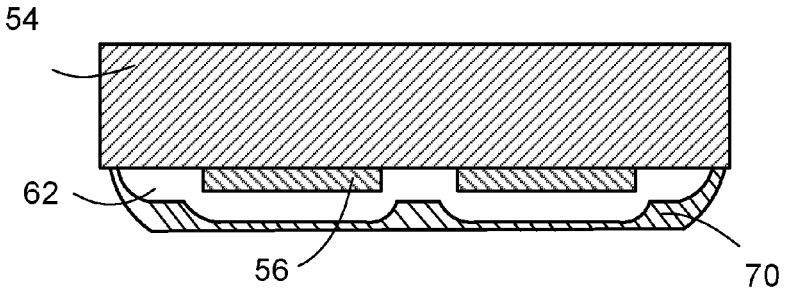
FIG. 5 is a partial, cross-sectional view of an improved fuser heater according to a third exemplary embodiment of the present invention.

In still another exemplary approach, as shown in FIG. 5, the filler material 70 is added substantially across the entire surface of the covering layer 62 to form a final exterior outer coating having a substantially even surface.

Figure 6:
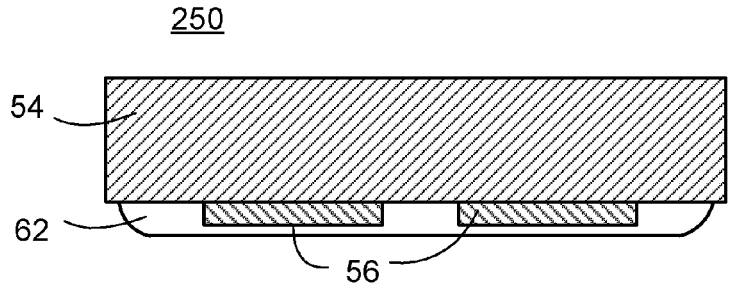
FIG. 6 is a partial, cross-sectional view of an improved fuser heater with added material thereon according to a fourth illustrative embodiment hereof.

FIG. 6 depicts a partial, cross-sectional detail view of a fuser heater 250 produced by another exemplary unevenness reduction step. In this approach, rather than using filler material to essentially fill outer surface low points, unevenness is reduced by chemically or abrasively removing material from covering layer 62. For example, the peaks of covering layer 62 may be reduced by an etching process, such as acid etching. Alternatively, other reduction processes such as sanding, grinding, cutting, chemical mechanical polishing, etc., may be employed.

Optionally, the above exemplary techniques may be combined, i.e., the peaks may be reduced or removed in an initial step, as described in the preceding paragraph, and then any remaining regions of unevenness may be filled in or covered over with an added exterior coating of filler material 70.

Figure 7:
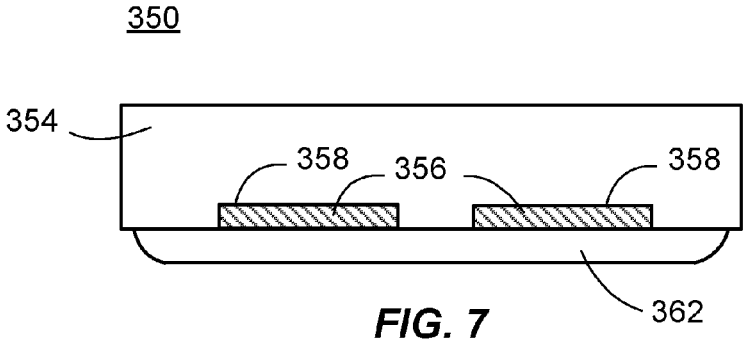
FIG. 7 is a partial, cross-sectional detail view of a fuser heater with counter-sunk heating elements according to a fifth illustrative embodiment hereof.

FIG. 7 depicts a partial, cross-sectional view of a fuser heater 350 produced by yet another exemplary unevenness reduction process. In this approach, the regions of unevenness are reduced by minimizing or eliminating conditions that cause the unevenness. In particular, in the embodiment of FIG. 7, rather than disposing the heating elements 356 on the surface of the base member 354, recessed wells or grooves 358 are formed in the base member 354. The heating elements 356 are then formed in or otherwise embedded into the wells or grooves 358 of the base member 354, such that the outer surfaces of the base member 354 and the heating elements 356 cooperate to provide a substantially even surface on which covering layer 362 is disposed. The resulting outer surface of covering layer 362 is substantially without a level of unevenness seen in prior heaters.

Accordingly, an improved heater for a belt-based fuser of an image-forming device 10 has been disclosed. In particular, the external surface of the heater which contacts the belt 40 should provide a substantially even surface. Any regions of unevenness which are present may be reduced by adding a step to the production of the heater assembly 50. Regardless of the particular approach selected, remaining regions of unevenness have been seen to be less than about 10 μm, and in particular between about 0.1 μm and about 7 μm.

The foregoing description of methods and exemplary approaches has been presented for purposes of illustration. It is not intended to be exhaustive or to limit the below-listed claims to the precise steps and/or forms disclosed, and obviously many modifications and variations are possible in light of the above teaching. It is intended that the scope of the disclosure be defined by the claims appended hereto.

The invention claimed is:

1. A fuser heater for a fuser of an image-forming device, said fuser heater comprising:

a base member;

at least one heating element directly disposed on the base member;

a covering layer covering and directly contacting the at least one heating element; and a filler material spaced apart from the at least one heating element and disposed on the covering layer providing a substantially even outer surface of the fuser heater, the substantially even outer surface of the fuser heater covering an entire surface of the base member, and the filler material has a thickness in a first portion thereof near a center of the base member that is greater than a thickness in at least one second portion of the filler material in proximity to the at least one heating element, wherein the substantially even outer surface of the fuser heater comprises both the covering layer and the filler material.

2. The fuser heater according to claim 1, wherein an amount of unevenness of the outer surface is less than about 10 μm.

3. The fuser heater according to claim 1, wherein an amount of unevenness is in the range of about 0.1 μm to about 7 μm.

4. The fuser heater according to claim 1, wherein the covering layer has one or more regions of unevenness, and the filler material is disposed on the covering layer in proximity to the one or more regions of unevenness.

5. The fuser heater according to claim 4, wherein the filler material is glass.

6. The fuser heater of claim 1, wherein the filler material is a composition that is different from a composition of the covering layer.

7. A process for producing a heater for a fuser of an image-forming device, comprising:

disposing one or more heating elements directly on a base member of the heater;

covering the one or more heating elements and the base member with a covering layer; and treating the covering layer with a filler material spaced apart from the one or more heating elements and disposed on the covering layer so as to form a substantially even outer surface of the heater, the substantially even outer surface of the heater covering an entire surface of the base member, and the filler material having a thickness in a first portion thereof near a center of the base member that is greater than a thickness in one or more second portions of the filler material in proximity to the one or more heating elements, wherein the substantially even outer surface comprises both the filler material and the covering layer.

8. The process according to claim 7, wherein an amount of unevenness of the outer surface is less than about 10 μm.

9. The process according to claim 7, wherein an amount of unevenness of the outer surface is between about 0.1 μm to about 7 μm.

10. The process according to claim 7, wherein the covering layer includes one or more regions of unevenness, and the treating comprises adding the filler material to lower portions of the one or more regions of unevenness.

11. The process according to claim 10, wherein the filler material is glass.

12. The process according to claim 7, wherein the filler material is a composition that is different from a composition of the covering layer.

13. A fuser heater for a fuser of an image-forming device, said fuser heater comprising:

a base member;

at least one heating element directly disposed on the base member;

a covering layer covering the at least one heating element; and a filler material spaced apart from the at least one heating element and the base member, and disposed on the covering layer and the base member such that a substantially even outer surface of the fuser heater comprises both the filler material and the covering layer, the substantially even outer surface of the fuser heater covering an entire surface of the base member.

14. The fuser heater of claim 13, wherein the filler material is a composition that is different from a composition of the covering layer.

15. The fuser heater of claim 13, wherein the covering layer directly contacts the at least one heating element and the base member.

* * * * *